US009622622B2

(12) United States Patent
Sundberg et al.

(10) Patent No.: US 9,622,622 B2
(45) Date of Patent: Apr. 18, 2017

(54) JUVENILE TUB

(71) Applicant: DOREL JUVENILE GROUP, INC., Foxboro, MA (US)

(72) Inventors: Brian C Sundberg, Chester, NH (US); Joseph D Langley, Foxboro, MA (US); Jorge Tomas, Wrentham, MA (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 198 days.

(21) Appl. No.: 14/454,423

(22) Filed: Aug. 7, 2014

(65) Prior Publication Data

US 2015/0040309 A1 Feb. 12, 2015

Related U.S. Application Data

(60) Provisional application No. 61/863,291, filed on Aug. 7, 2013.

(51) Int. Cl.

| | |
|---|---|
| ***A47K 3/06*** | (2006.01) |
| ***A47K 3/024*** | (2006.01) |
| *A47K 3/034* | (2006.01) |

(52) U.S. Cl.

CPC ..... *A47K 3/06* (2013.01); *A47K 3/024* (2013.01); *A47K 3/034* (2013.01)

(58) Field of Classification Search

CPC ..... A47K 3/06; A47K 3/064; A47K 3/024; A47K 3/034

See application file for complete search history.

(56) References Cited

U.S. PATENT DOCUMENTS

| | | | | |
|---|---|---|---|---|
| 4,266,306 | A * | 5/1981 | Lee | A47K 3/164 248/408 |
| RE32,806 | E | 12/1988 | Gurolnick | |
| 5,276,926 | A | 1/1994 | Lopez | |
| D350,597 | S | 9/1994 | Wise | |
| D350,598 | S | 9/1994 | Wise et al. | |
| 5,361,429 | A | 11/1994 | Lin | |
| 5,361,430 | A | 11/1994 | Wise | |
| 5,425,149 | A * | 6/1995 | Crossley | A47K 3/064 4/572.1 |
| 5,588,158 | A | 12/1996 | Poulson et al. | |
| 5,588,159 | A | 12/1996 | Poulson et al. | |
| 6,018,826 | A | 2/2000 | Yang | |
| 6,112,343 | A | 9/2000 | Dixon | |
| 6,253,392 | B1 | 7/2001 | Conforti et al. | |
| RE37,481 | E | 12/2001 | Crossley et al. | |
| 6,507,959 | B1 | 1/2003 | Sundberg et al. | |
| 6,578,209 | B2 | 6/2003 | Lopes et al. | |
| 6,785,917 | B1 | 9/2004 | Bryant | |
| 7,032,259 | B1 | 4/2006 | Kilion | |
| 7,065,805 | B1 | 6/2006 | Sundberg | |
| D538,897 | S | 3/2007 | Erli | |
| 7,886,375 | B2 | 2/2011 | Thorne et al. | |
| 8,302,218 | B2 | 11/2012 | Dignitti et al. | |

(Continued)

OTHER PUBLICATIONS

Summer Instruction Manual "Newborn to Toddler Fold Away Baby Bath", Oct. 2009, pp. 1-4.

*Primary Examiner* — Janie Loeppke

(74) *Attorney, Agent, or Firm* — Barnes & Thornburg LLP

(57) ABSTRACT

A juvenile tub is configured to support an infant during bath time. The tub is foldable to assume a compact shape for storage.

28 Claims, 12 Drawing Sheets

(56) References Cited

U.S. PATENT DOCUMENTS

| | | | | |
|---|---|---|---|---|
| 2006/0143819 | A1* | 7/2006 | Davis | A47K 3/024<br>4/572.1 |
| 2007/0033727 | A1 | 2/2007 | Liu | |
| 2008/0295239 | A1 | 12/2008 | Ristuccia et al. | |

* cited by examiner 14
152T1
152R1
152S
152H1
152H
152
15

400
LATCH CAM
401
141
20
204
207
153
151
100
12
SEE FIG. 10A
LATCH
152
16
172H
172G
17
117
162
102
22
14
10
16A
160
21
12
SEE FIG. 9A
141
142
115
152H
152G
14A
101

152H2
LATCH

LATCH RETAINER
LATCH CAM
LATCH
SEE FIG. 14A

JUVENILE TUB

PRIORITY CLAIM

This application claims priority under 35 U.S.C. §119(e) to U.S. Provisional Application Ser. No. 61/863,291, filed Aug. 7, 2013, which is expressly incorporated by reference herein.

BACKGROUND

The present disclosure relates to portable baby bathtubs, and particularly to tubs that can be used in sinks. More particularly, the present disclosure relates to foldable bathtubs for children.

SUMMARY

According to the present disclosure, a juvenile tub comprises a base, a foldable footrest coupled to the base, and a foldable headrest coupled to the base. The base is formed to store bathwater for bathing a child placed in the juvenile tub.

In illustrative embodiments, the central base is formed to include an elevated child-receiving cradle located between separate first and second bathwater reservoirs formed in the central base. The central base includes an upwardly extending contoured and rounded in-molded first side bolster positioned to lie between the first bathwater reservoir and the child-receiving cradle. The central base also includes an upwardly extending contoured and rounded in-molded second side bolster positioned to lie between the child-receiving cradle and the second bathwater reservoir. The side bolsters have an ergonomic shape selected in accordance with the present disclosure to provide means for supporting children of multiple sizes and ages in a proper position in the child-receiving cradle during bath time.

In illustrative embodiments, a lock is provided for each of the pivotable footrest and headrest. The footrest lock is mounted for pivotable movement on a foot end of the central base and configured to mate with a footrest lock receiver included in the footrest. The headrest lock is mounted for pivotable movement on a head end of the central base and configured to mate with a headrest lock receiver included in the headrest. Each of the footrest and headrest lock receivers includes a latch cam and a latch retainer arranged to mate with a spring-biased latch included in the companion lock.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figures 1, 2, 3:
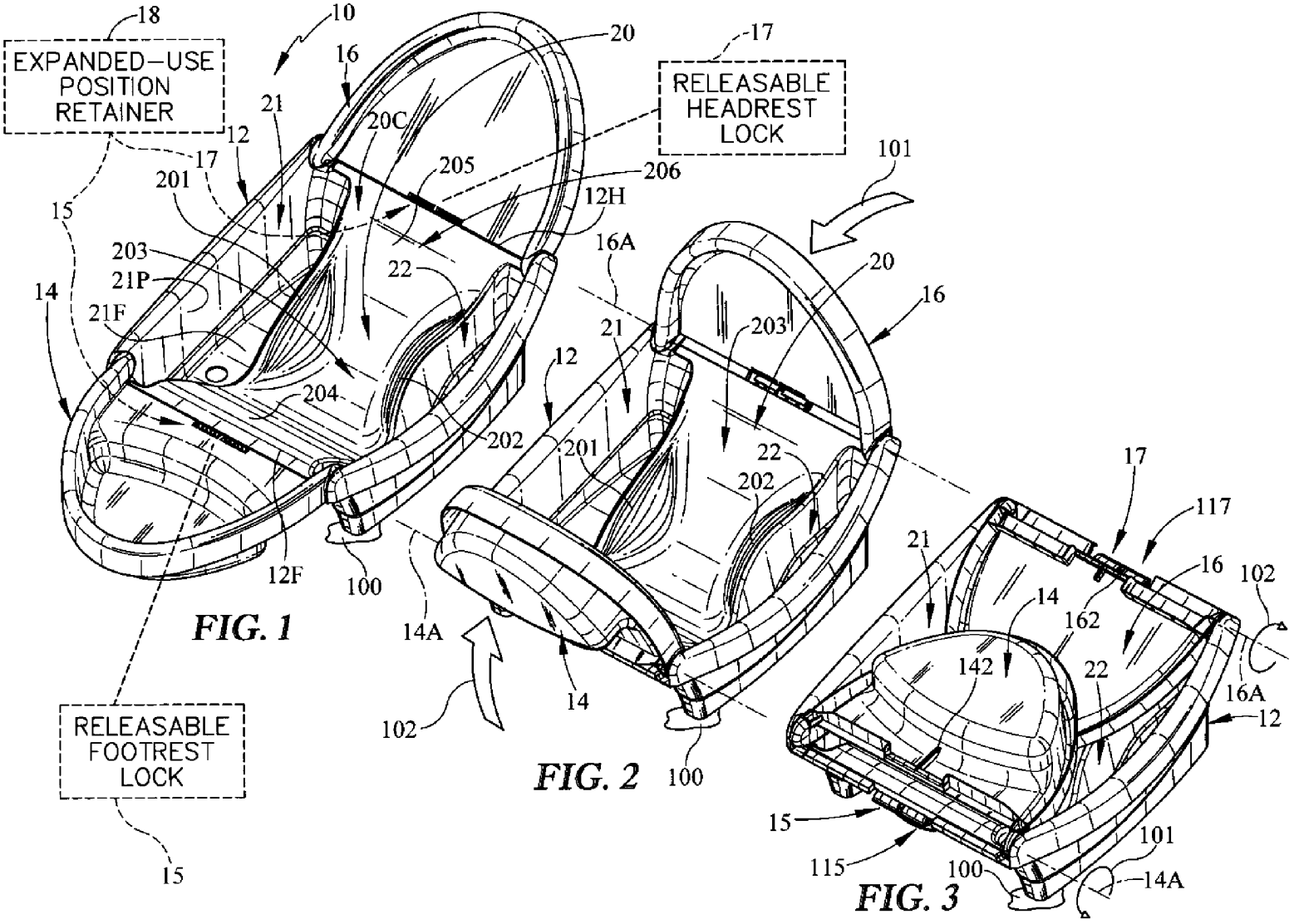
FIG. 1 is a perspective view of a juvenile tub in accordance with the present disclosure showing that the tub includes a central base formed to include an elevated child-receiving cradle flanked by two bathwater reservoirs and showing that the child-receiving cradle is defined by a rearwardly sloping inclined backrest, a forwardly sloping inclined seat, and a pair of laterally spaced-apart ergonomically contoured side bolsters separating the seat and the backrest from the bathwater reservoirs and cooperating to limit lateral side-to-side movement of a child placed in the child-receiving cradle during bath time and showing a lockable folding footrest coupled to a forward (near) end of the central base for pivotable movement about a footrest axis as suggested in FIG. 2 and a lockable folding headrest coupled to an opposite rearward (far) end of the central base for pivotable movement about a headrest axis as suggested in FIG. 2.
FIG. 2 is a perspective view similar to FIG. 1 showing forward pivoting movement of the headrest about the headrest axis toward the footrest away from an expanded-use position shown in FIG. 1 and rearward pivoting movement of the footrest about the footrest axis toward the headrest away from an expanded-use position shown in FIG. 1.
FIG. 3 is a perspective view similar to FIGS. 1 and 2 showing the headrest and footrest in their collapsed-storage positions overlying the central base.

A juvenile tub 10 includes a central base 12, a pivotable footrest 14, a releasable footrest lock 15, a pivotable headrest 16, and a releasable headrest lock 17 as suggested illustratively and diagrammatically in FIGS. 1-4. Central base 12 is formed to include an elevated child-receiving cradle 20 flanked by left-side and right-side bathwater reservoirs 21, 22 as shown, for example, in FIGS. 1, 17, and 18.

Figures 9, 9A, 10, 10A:
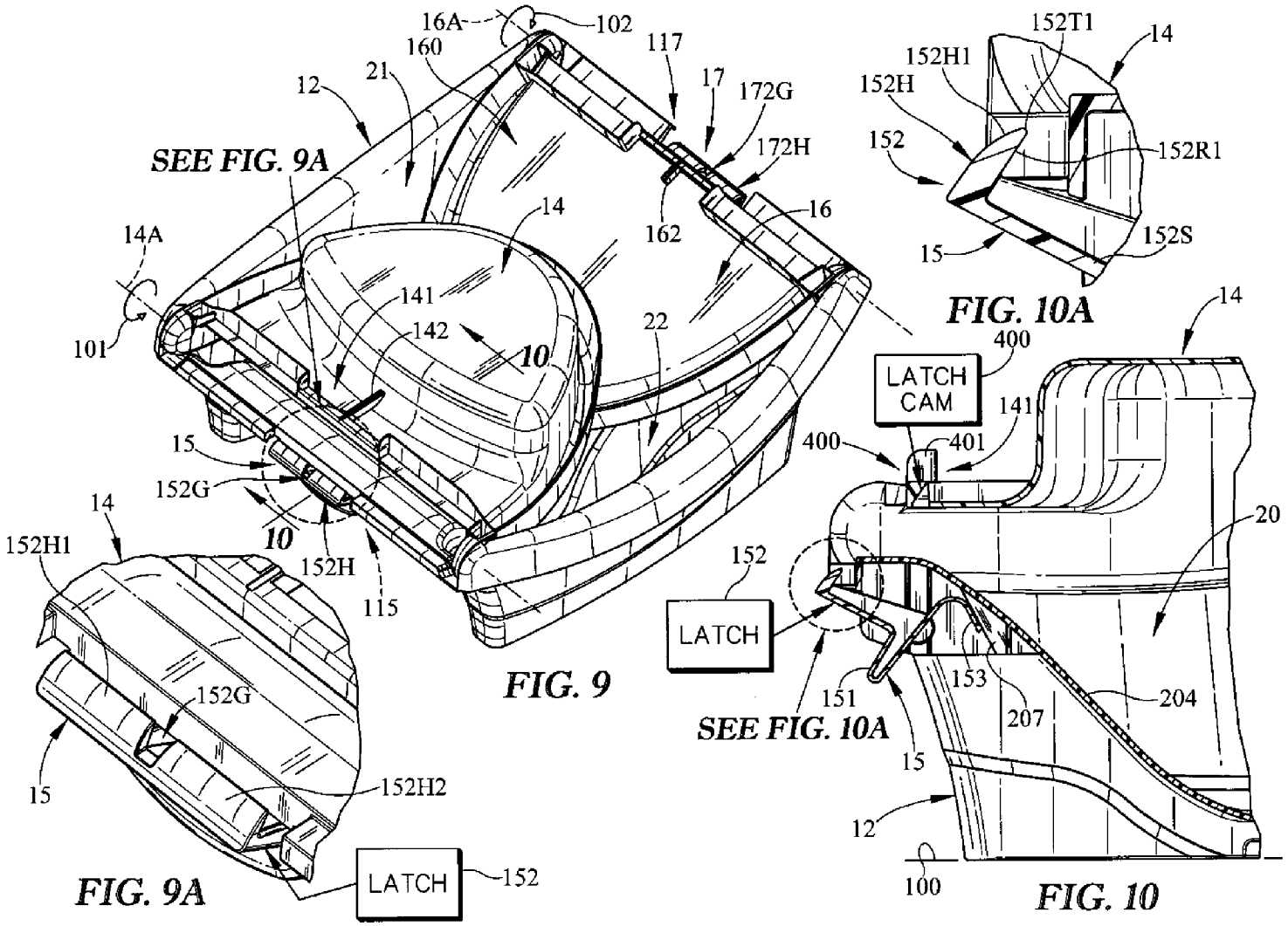
FIG. 9 is an enlarged view of the juvenile tub of FIGS. 1-3 showing the headrest and footrest in their collapsed-storage positions.
FIG. 9A is an enlarged view of the circled region of FIG. 9 showing formation of two side-by-side convex exterior cam-follower surfaces provided on a hook included in a free end of the cantilevered hook support also included in the latch.
FIG. 10 is a partial sectional view taken along line 10-10 of FIG. 9 showing separation of the latch included in the footrest lock from the latch cam included in the footrest lock receiver when the footrest occupies the collapsed-storage position shown in FIG. 9.
FIG. 10A is an enlarged view of the circled region of FIG. 10 showing the curvature of the convex exterior cam-follower surface of the latch hook.
Figures 13, 13A, 14, 14A:
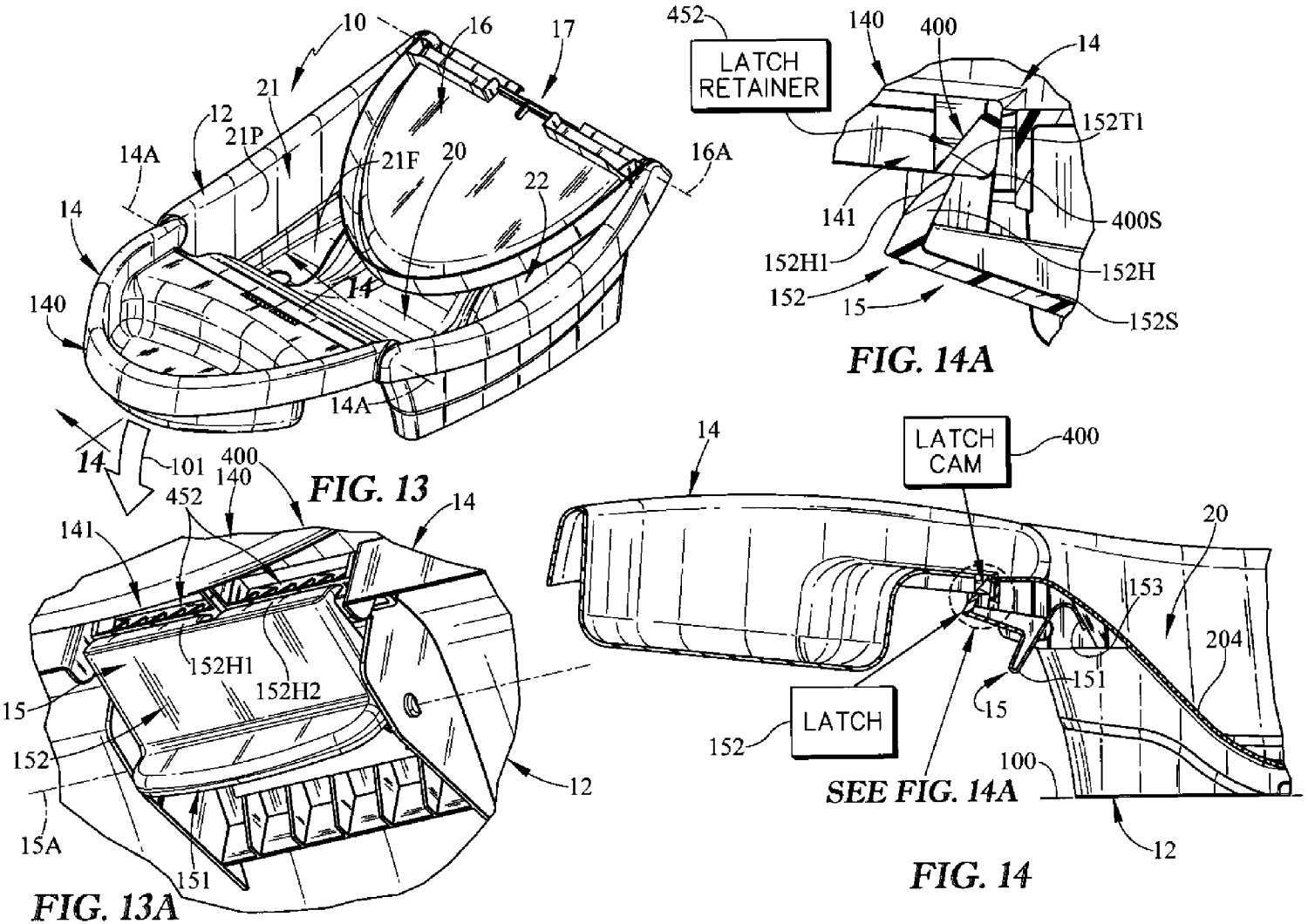
FIG. 13 is a perspective view similar to FIG. 11 showing the position of the footrest as it is pivoting in a counterclockwise direction about the footrest-lock axis and just before it reaches the expanded-use position shown in FIG. 15.
FIG. 13A is a partial perspective view of the juvenile tub of FIG. 13 showing engagement of the latch on an exterior surface of the latch cam.
FIG. 14 is an enlarged partial sectional view taken along line 14-14 showing engagement of a tip of the latch hook on an exterior surface of the latch cam just before snap-engagement of the spring-biased latch hook and a latch retainer included in the footrest lock receiver and located in close proximity to the latch cam to retain the footrest in the expanded-use position shown in FIGS. 1 and 15-17.
FIG. 14A is an enlarged view of the circled region of FIG. 14.
Figure 15:
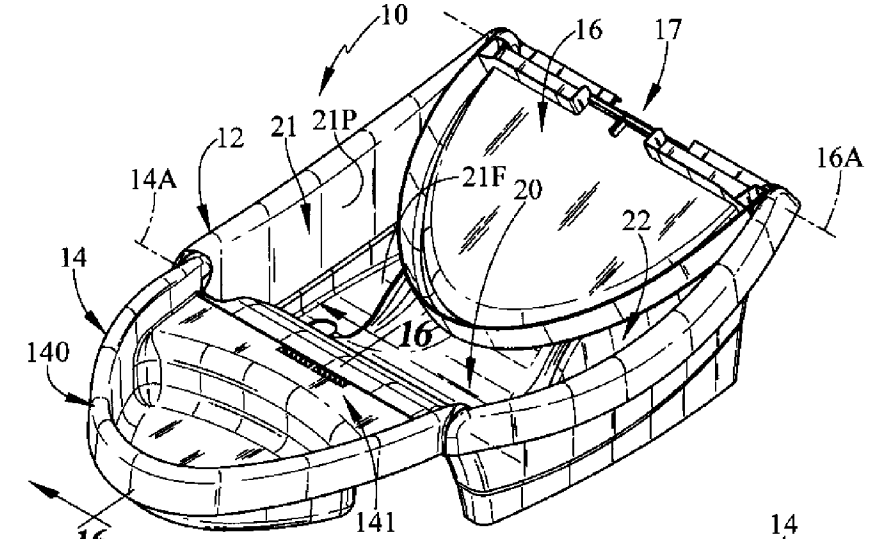
FIG. 15 is a perspective view similar to FIGS. 11 and 13 showing the footrest in the expanded-use position.
Figure 16:
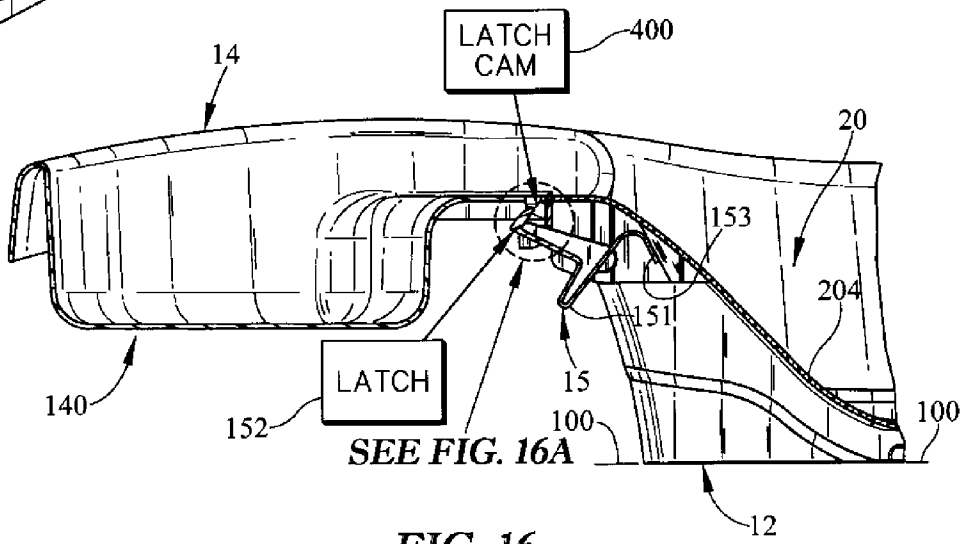
FIG. 16 is an enlarged partial sectional view taken along line 16-16 showing the hook included in the latch of the footrest lock extending into a hook-retainer space defined by the footrest lock receiver to mate with the latch retainer to retain the footrest in the expanded-use position.
Figure 16A:
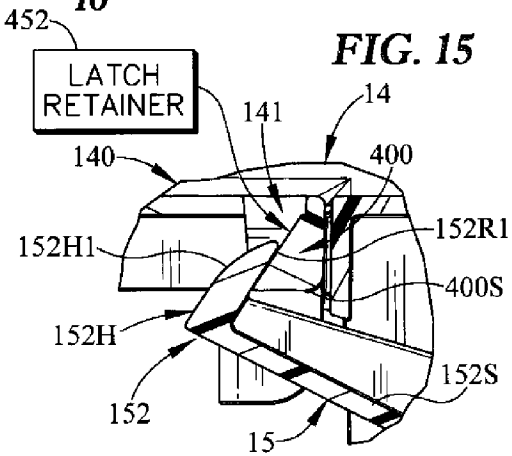
FIG. 16A is an enlarged view of the circled region of FIG. 16.

Releasable footrest lock 15 is mounted on a foot end 12F of central base 12 and operates automatically to retain footrest 14 in an expanded-use position shown in FIGS. 1 and 15 once footrest 14 has been pivoted from a compact collapsed-storage position shown in FIGS. 3 and 9 in a counterclockwise direction 101 about a footrest axis 14A as suggested in FIGS. 9-16. Footrest lock 15 includes a spring-biased latch 152 having a hook 152H that is first cammed on a latch cam 400 included in footrest 14 and then mated with a latch retainer 452 included in footrest 14 during pivoting movement of footrest 14 about footrest axis 14A in counterclockwise direction 101 to retain footrest 14 in an expanded-use position shown in FIGS. 1 and 15.

Releasable headrest lock 17 is mounted on a head end 12H of central base 12 and operates automatically to retain headrest 16 in an expanded-use position also shown in FIGS. 1 and 15 once headrest 16 has been pivoted from the compact collapsed-storage position shown in FIGS. 3 and 9 in a clockwise direction 102 about a headrest axis 16A. Headrest lock 17 includes a spring-biased latch 172 having a hook 172H that is first cammed on a latch cam 600 included in headrest 16 and then mated with a latch retainer 652 included in headrest 16 during pivoting of headrest 16 about headrest pivot axis 16A in clockwise direction 102 to retain headrest 16 in an expanded-use position shown in FIG. 1.

Footrest lock 15 and headrest lock 17 cooperated to define an expanded-use position retainer 18 as suggested in FIG. 1. Retainer 18 is configured to retain footrest 14 and headrest 16 in the expanded-use position automatically in response to pivoting movement of footrest 14 about footrest axis 14A and pivoting movement of headrest 16 about headrest axis 16A to the expanded-use positions as suggested in FIGS. 2 and 3.

Central base 12 remains in a stationary position on an underlying surface 100 during opening and closing pivoting movement of footrest 14 about footrest axis 14A as suggested in FIGS. 1-3 and 10, 12, 14, and 16. Central base 12 also remains stationary during opening and closing pivoting movement of headrest 16 about headrest axis 16A as suggested in FIGS. 1-3.

Figure 4:
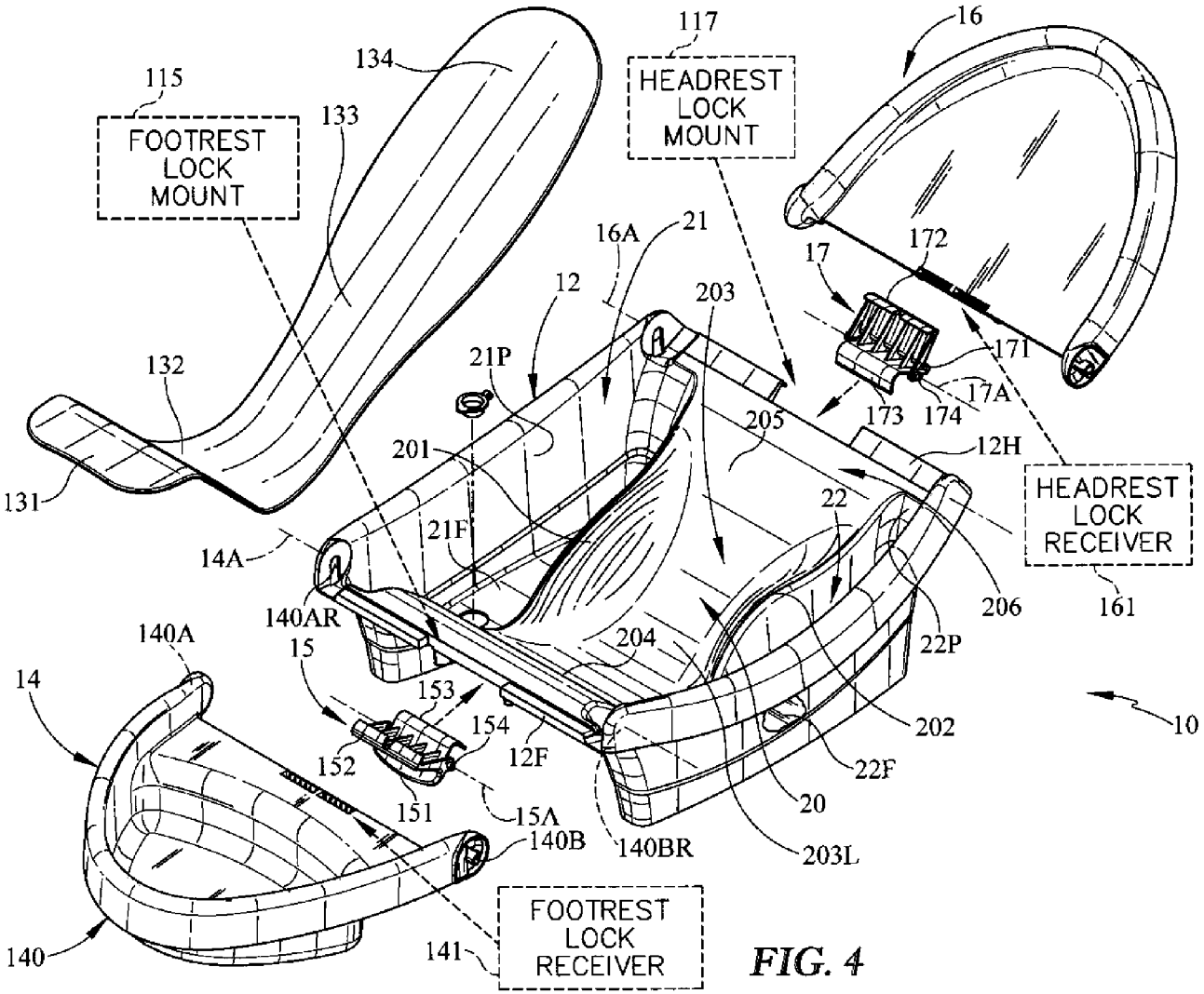
FIG. 4 is an exploded perspective assembly view of the juvenile tub components shown in FIGS. 1-3 along with a pliable bathmat and showing illustrative embodiments of the releasable footrest and headrest locks shown diagrammatically in FIG. 1 and configured to be mounted for pivotable movement on opposite ends of the central base as suggested in FIG. 5 (footrest lock) and in FIG. 21 (headrest lock) and showing formation of the footrest to include a footrest lock receiver (shown in phantom) for mating with the footrest lock to retain the footrest in the expanded-use position shown in FIG. 1 and formation of the headrest to include a headrest lock receiver (shown in phantom) for mating with the headrest lock to retain the headrest in the expanded-use position shown in FIG. 1.
Figure 17:
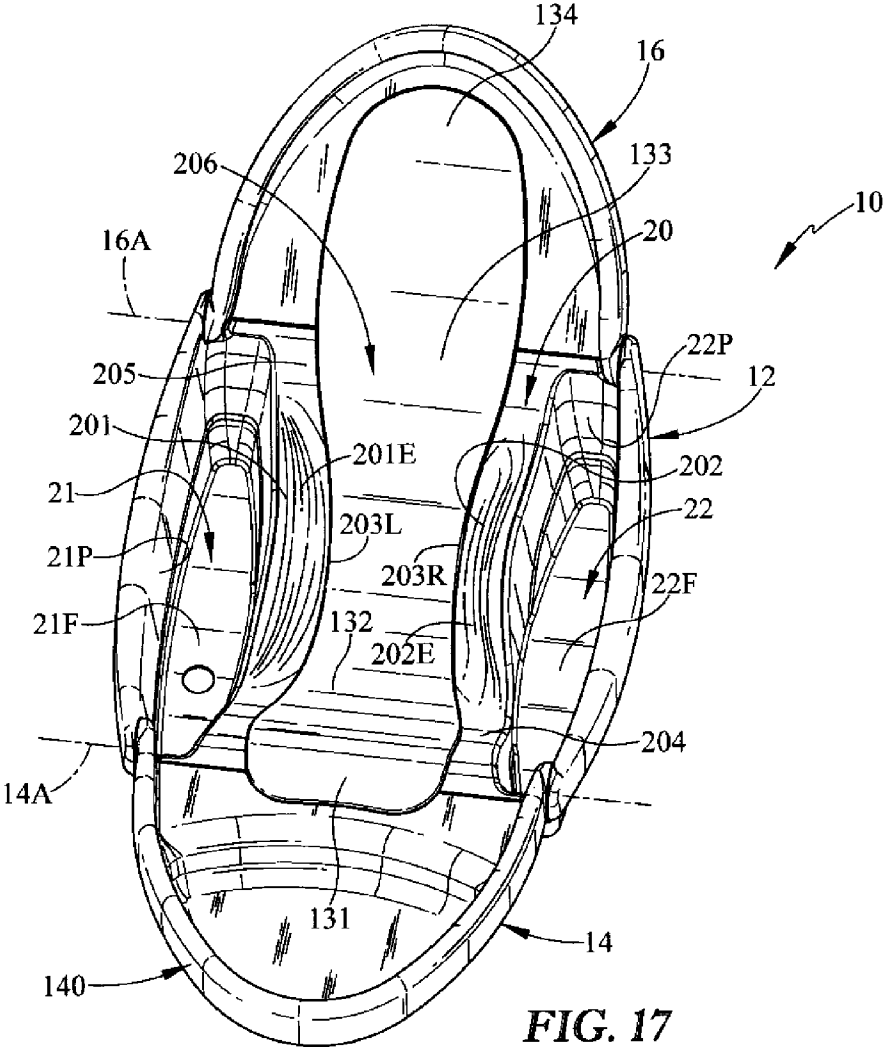
FIG. 17 is a top perspective view of the juvenile tub of FIG. 1 showing the bathmat in place on portions of footrest, inclined seat, inclined backrest, and headrest and between the laterally spaced-apart and inwardly extending ergonomically contoured side bolsters of the child-receiving cradle and showing a left-side bathwater reservoir provided with a drain on a left side of the elevated cradle and a separate right-side bathwater reservoir on the right side of the elevated cradle.
Figure 19:
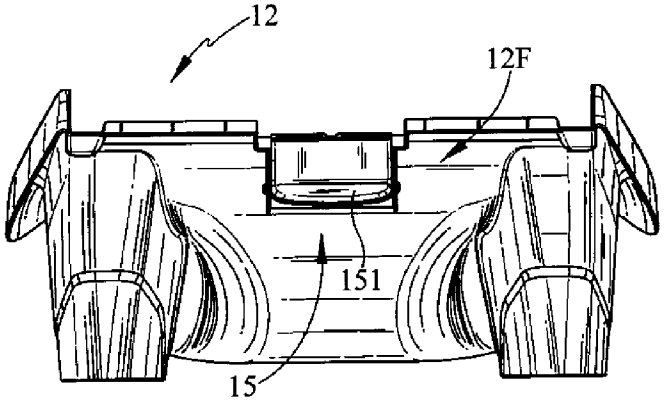
FIG. 19 is a foot-end front elevation of the central base of FIG. 18.
Figure 20:
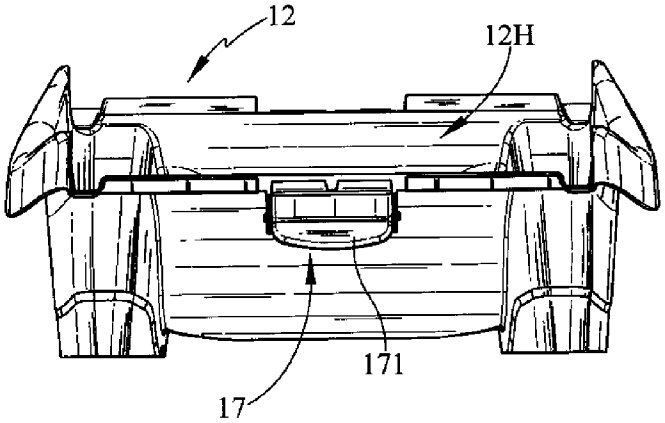
FIG. 20 is a head-end rear elevation of the central base of FIG. 18.
Figure 18:
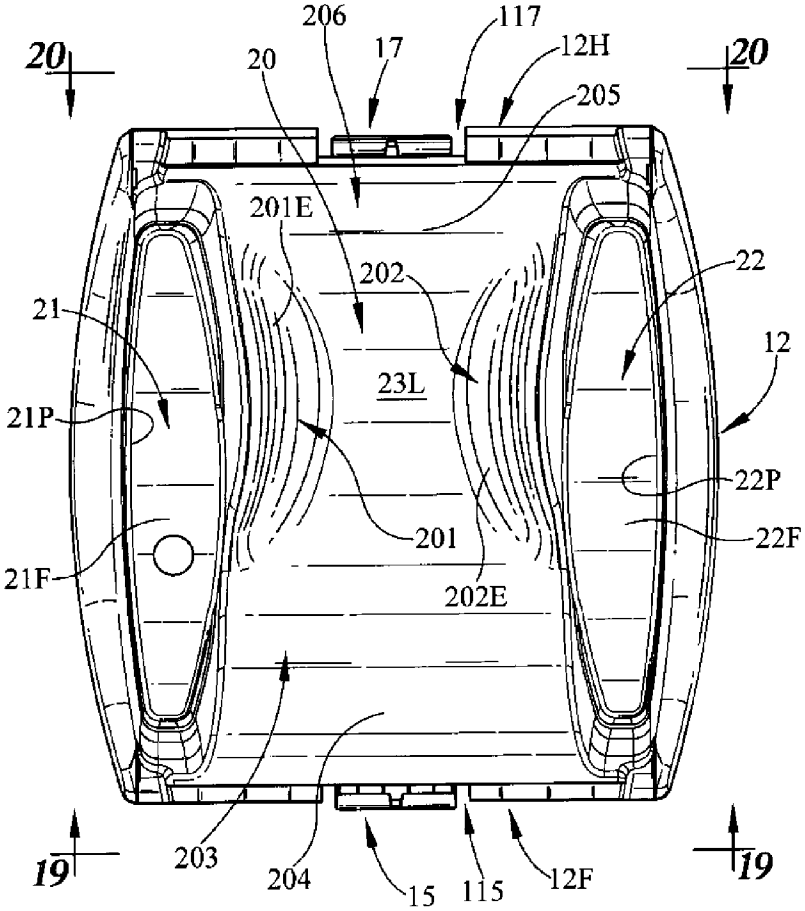
FIG. 18 is a top plan view of the central base of the juvenile tub of FIGS. 1 and 17.

Child-receiving cradle 20 of central base 12 includes an upwardly extending ergonomically contoured first side bolster 201 that is adjacent to left-side bathwater reservoir 21 and an upwardly extending ergonomically contoured second side bolster 202 that is laterally spaced apart from first side bolster 201 and adjacent to right-side bathwater reservoir 22 as suggested in FIGS. 1, 4, and 17. A child-support surface 203 is positioned to lie between and is coupled to side bolsters 201, 202 and configured to support a child in a supine position between left-side and right-side bathwater reservoirs 21, 22 during bath time. Child-support surface 203 includes a forwardly sloping inclined seat 204 extending from foot end 12F to a midpoint of the side bolsters 201, 202 and a rearwardly sloping inclined backrest 205 extending from seat 204 to headrest end 12H as shown, for example, in FIGS. 1 and 4. Seat 204 and backrest 205 cooperate in illustrative embodiments to provide child-support surface 203 with an upwardly facing concave surface as suggested in FIGS. 1, 10, and 21. Child-support surface 203 has a generally hourglass-shaped profile when viewed from above as suggested in FIGS. 1 and 18.

Left-side bathwater reservoir 21 is defined by a low-elevation floor 21F and an endless side panel 21P surrounding and extending upwardly from a perimeter edge of low-elevation floor 21F as suggested in FIGS. 4 and 17. Right-side bathwater reservoir 22 is defined by a low-elevation floor 22F and an endless side panel 22P surrounding and extending upwardly from a perimeter edge of low-elevation floor 22F as suggested in FIGS. 4 and 17.

Child-receiving cradle 20 is configured to provide an elevated bathwater channel 20C in which a child can be retained during bath time between left-side and right-side bathwater reservoirs 21, 22 as shown, for example, in FIG. 1. Side bolsters 201, 202 are laterally spaced apart from one another and cooperate to form side walls of the elevated bathwater channel and seat 204 and backrest 205 of child-support surface 203 cooperate to form a floor of the elevated bathwater channel 20C.

Side bolsters 201, 202 are contoured so as to be optimized ergonomically to receive both small-sized and larger-sized infants on the child-support surface 203 provided between side bolsters 201, 202 as suggested in FIG. 1. As suggested in FIGS. 1, 4, 17, and 18, left-side bolster 201 has a rounded and ergonomically contoured convex exterior surface facing toward an opposing similar rounded and ergonomically contoured convex exterior surface of right-side bolster 202. First side bolster 201 separates child-support surface 203 from left-side bathwater reservoir 21. Second side bolster 202 separates child-support surface 203 from right-side bathwater reservoir 22. In illustrative embodiments, the lowest portion 203L of child-support surface 203 is elevated above low-elevation floor 21F of left-side bathwater reservoir 21 and above low-elevation floor 22F of right-side bathwater reservoir 22 as suggested in FIG. 4.

Left-side bolster 201 includes a convex exterior surface 201E arranged to face toward the child-support surface 203 as shown in FIG. 17. Right-side bolster 202 includes a convex exterior surface 202E arranged to face toward the child-support surface 203 and the convex exterior surface 201E of the left-side bolster 201 and cooperate therewith to form an elevated bathwater channel 20C located between the left-side and right-side bathwater reservoirs 21, 22.

Child-support surface 203 includes a forwardly sloping inclined seat 204 extending from the foot end 12F of central base 12 to a midpoint of the first and second side bolsters 21, 22 and a rearwardly sloping inclined backrest 205 extending from the forwardly sloping inclined seat 204 to the head end 12H of central base 12 as suggested in FIGS. 4 and 17. The rearwardly sloping inclined backrest 205 cooperates with the forwardly sloping inclined seat 204 to define the floor of the elevated bathwater channel 20C.

Child-support surface 203 includes a left concave curved perimeter edge 203L along a left side thereof and a right concave curved perimeter edge 203R along a right side thereof as suggested in FIG. 17. The convex exterior surface 201E of the left-side bolster 201 includes a convex curved perimeter edge arranged to mate with and extend along the left concave curved perimeter edge 203L of the child-support surface 203. The convex exterior surface 202 of the right-side bolster 202 includes a convex curved perimeter edge arranged to mate with and extend along the right concave curved perimeter edge 203R of the child-support surface 203.

Juvenile tub 10 also includes a pliable bathmat 13 as shown, for example, in FIGS. 4 and 17. Bathmat 13 includes, in series, a foot portion 131 mating with foldable footrest 14, a seat portion 132 mating with forwardly sloping inclined seat 204 of central base 12, a back portion 133 mating with rearwardly sloping inclined backrest 205, and a head portion 134 mating with foldable headrest 16. Bathmat 13 remains in place on tub 10, whether footrest 12 and headrest 16 are in their expanded-use or collapsed-storage positions in illustrative embodiments of the present disclosure.

Figures 5, 6:
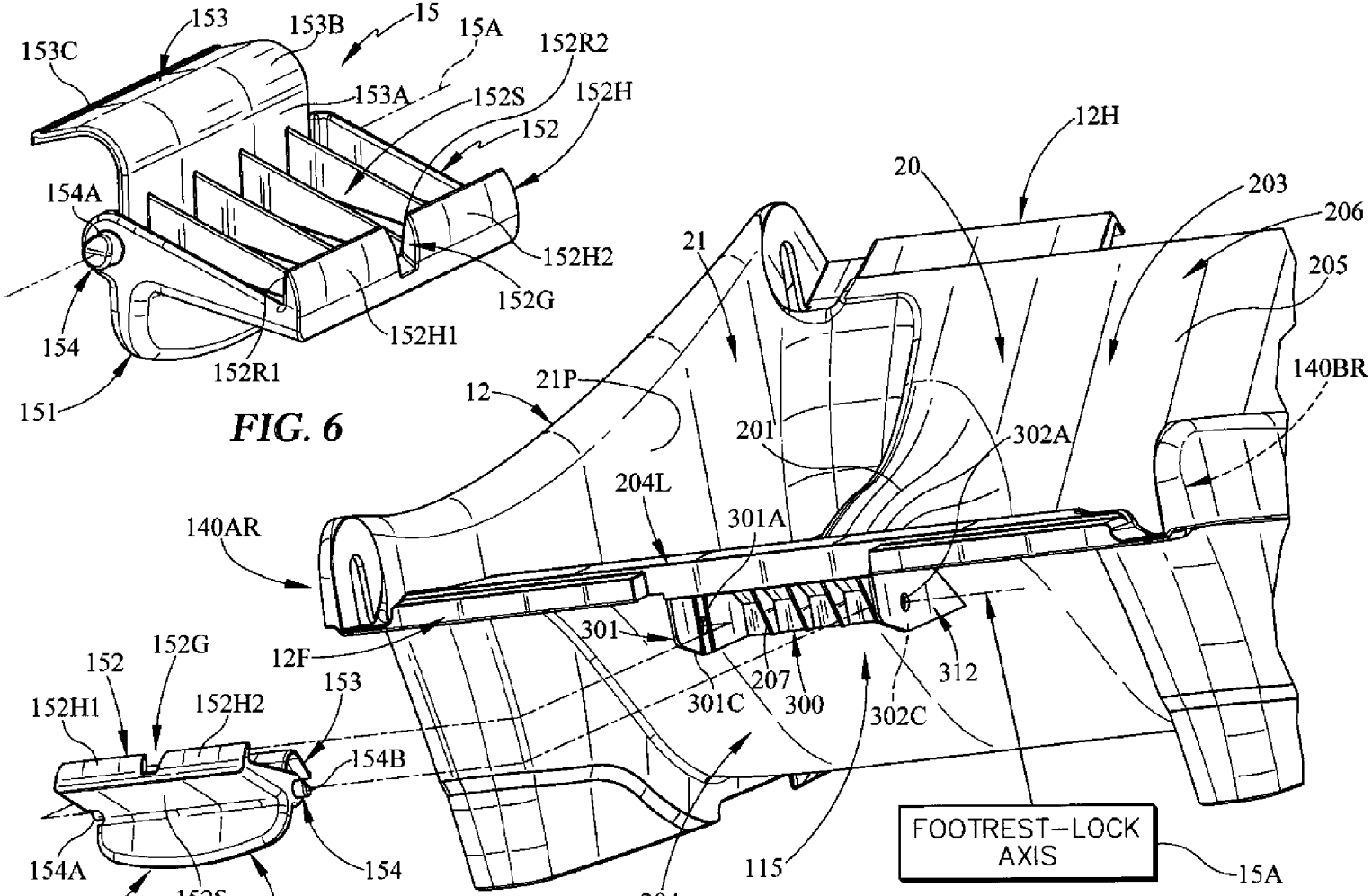
FIG. 5 is an enlarged partial perspective view of a foot end of the central base and showing that the central base is formed to include a footrest lock mount located under the seat of the child-receiving cradle included in the central base and configured to support the footrest lock for pivotable movement about a footrest-lock axis.
FIG. 6 is an enlarged perspective view of the footrest lock shown in FIGS. 4 and 5 and showing that the footrest lock includes a pivot axle, a latch extending to the right, a latch-biasing spring extending upwardly and to the left, and a downwardly extending latch-release handle and showing that the latch includes a hook carried on the free end of a cantilevered hook support.

As suggested in FIGS. 4 and 5, releasable footrest lock 15 is configured to be coupled to a footrest lock mount 115 formed in foot end 12F of central base 12. Footrest lock 15 is mounted as suggested in FIG. 5 for pivotable movement about a footrest-lock axis 15A at the option of a caregiver to lock and unlock footrest 14 to control pivotable movement of footrest 14 about footrest axis 14A between an expanded-use position shown in FIG. 1 and a collapsed-storage position shown in FIG. 3.

Releasable footrest lock 15 includes a latch-release handle 151, a latch 152, a latch-biasing spring 153, and a pivot axle 154 arranged to extend along footrest-lock axis 15A as shown, for example, in FIG. 6. Footrest lock 15 is a monolithic element made of an elastic plastics material in an illustrative embodiment to provide elasticity to spring 153. Latch-biasing spring 153 is sized and shaped to engage a flange 207 coupled to the underside of child-support surface 203 as suggested in FIG. 10 and deform elastically to provide spring means for yieldably biasing latch 152 to mate with a latch retainer 452 included in footrest 14 so that footrest 14 is retained in the expanded-use position automatically whenever a caregiver moves the footrest 14 about footrest pivot axis 14A in counterclockwise direction 101 to assume the expanded-use position shown in FIG. 1.

Latch-biasing spring 153 is defined by a sheet made of the elastic plastics material. The sheet is formed to have a generally V-shaped cross-section and to include a proximal flat panel 153A, a distal flat panel 153C, and a curved bight panel 153B arranged to interconnect panels 153A, 153C as suggested in FIG. 6. Proximal flat panel 153A is anchored to a body comprising latch 152 and latch-release handle 151 as shown, for example, in FIG. 6. Distal flat panel 153C is formed to include a free end of spring 153 as shown, for example, in FIG. 6.

Figures 11, 11A, 12, 12A:
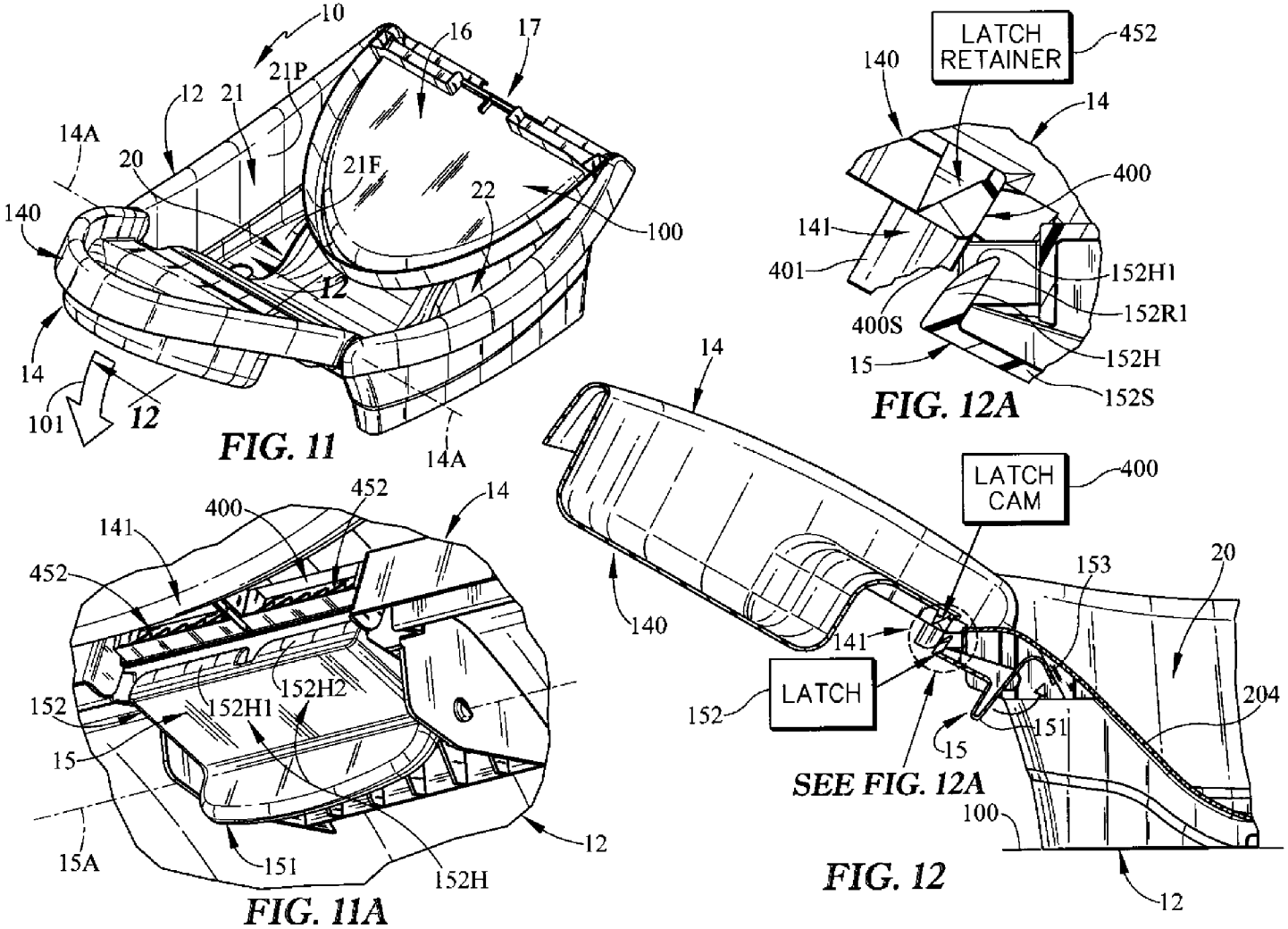
FIG. 11 is a perspective view similar to FIG. 9 showing counterclockwise pivotable movement of the footrest about the footrest axis toward the expanded-use position.
FIG. 11A is a partial perspective view of the juvenile tub of FIG. 11 showing the convex exterior surfaces of the hook on the free end of the latch of the footrest lock just before they mate in camming engagement with the latch cam included in the footrest lock receiver of the footrest.
FIG. 12 is a partial sectional view taken along line 12-12 of FIG. 11 showing the convex exterior cam-follower surface of the latch hook in close proximity to the convex curved exterior surface provided on the latch cam included in the footrest lock receiver of the footrest to pivot the latch in a counterclockwise direction about the footrest-lock axis against a biasing force generated by the latch-biasing spring.
FIG. 12A is an enlarged view of the circled region of FIG. 12 with a portion of an axle-mount flange included in the central base and shown in FIG. 11A broken away.

Latch-release handle 151 is coupled to latch 152 to pivot therewith as suggested in FIGS. 10, 12, and 14. Latch-release handle 151 is configured to provide means for pivoting latch 152 about footrest-lock pivot axis 15A in a counterclockwise direction relative to central base 12 to disengage the latch retainer formed in the footrest lock receiver of foldable footrest 14 to be pivoted by a caregiver about footrest axis 14 from the expanded-use position to the collapsed storage position to load latch-biasing spring 153.

As suggested in FIG. 6, latch 152 of footrest lock 15 includes a cantilevered hook support 152S and a hook 152H coupled to a free end of hook support 152S. Hook 152H is formed to include: (1) two side-by-side, spaced-apart, convex, exterior, cam-follower surfaces 152S1, 152S2; (2) oppositely facing hook-retainer surfaces 152R1, 152R2; and (3) tips 152T1, 152T2 located between the cam-follower surfaces and the hook-retainer surfaces as shown, for example, in FIGS. 6 and 9A. In illustrative embodiments, a rib-receiving gap 152G is provided between these cam-follower surfaces 152S1, 152S2 as suggested further in FIG. 9 to receive a rib 142 coupled to an underside of a footrest shell 140 included in footrest 14 when footrest 14 is moved to assume the expanded-use position shown in FIG. 1.

Footrest lock mount 115 is formed in central base 12 of juvenile tub 10 as shown, for example, in FIGS. 4 and 5. Footrest lock mount 115 is coupled to the underside of forwardly sloping inclined seat 204 and a laterally extending lip 204L associated with forwardly sloping inclined seat 204 and provided at foot end 12F of central base 12. Footrest lock mount 115 includes a forwardly extending first axle-mount flange 301, a laterally spaced-apart forwardly extending second axle-mount flange 302, and a rigidifying structure 300 arranged to lie between and interconnect first and second axle-mount flanges 301, 302 as shown, for example, in FIG. 5. Each of axle-mount flanges 301, 302 is formed to include an axle-receiving aperture 301A or 302A and companion aperture lead-in channel 301C or 302C for conducting an axle 154A or 154B to its companion aperture 301A or 302A during installation of footrest lock 15 on footrest lock mount 115. It is within the scope of this disclosure to provide headrest lock mount 117 with a similar structure.

Figure 7:
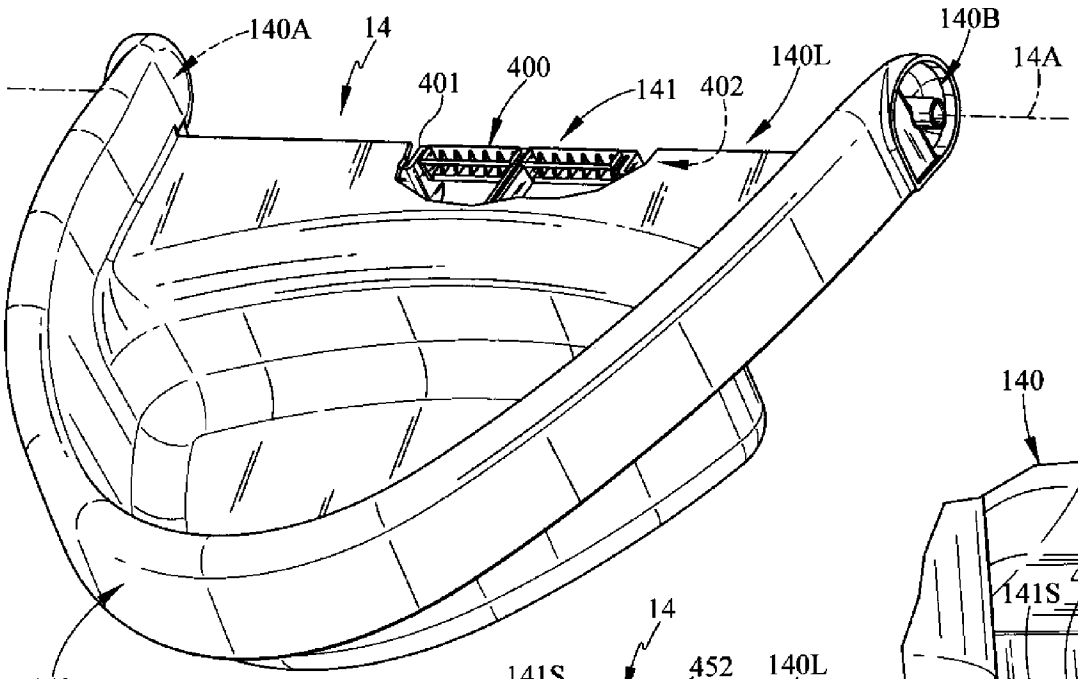
FIG. 7 is an enlarged perspective view of the footrest with portions of a footrest shell broken away to show the footrest lock receiver.
Figure 8:
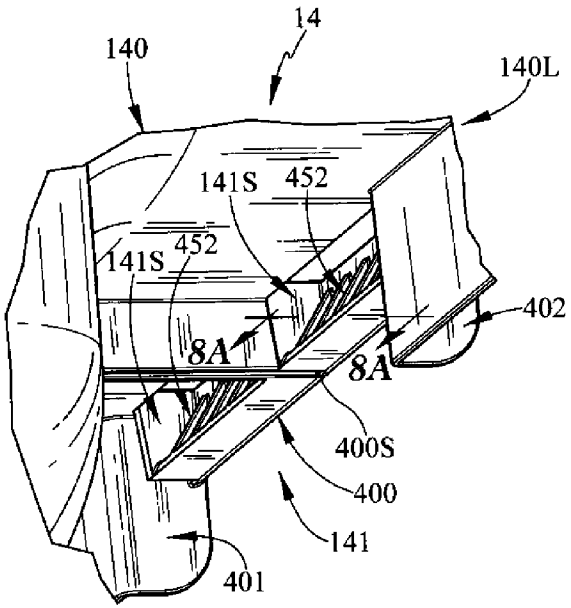
FIG. 8 is an enlarged perspective view of a portion of the underside of the footrest showing the footrest lock receiver in more detail.

Releasable footrest lock 15 mounted on central base 12 is configured to mate with a footrest lock receiver 141 included in footrest 14 as suggested diagrammatically in FIG. 4 and illustratively in FIGS. 7 and 8 automatically whenever a caregiver pivots footrest 14 about footrest axis 14A in counterclockwise direction 101 from the collapsed-storage position shown in FIG. 3 to the expanded-use position shown in FIG. 1. Footrest 14 is locked temporarily in the expanded-use position whenever latch hook 152H of footrest lock 15 mates with latch retainer 452 of footrest lock receiver 141 of footrest 14 as shown, for example, in FIGS. 15 and 16. To unlock footrest 14 so that it is free to be pivoted about footrest axis 14A in clockwise direction 102 to the collapsed-storage position overlying central base 12 as shown in FIG. 3, a caregiver need only reach under footrest 14 and grip a latch-release handle 151 included in footrest lock 15 and then apply a clockwise torque to rotate footrest lock 15 to move latch 152 (so as to compress the latch-biasing spring 153) to disengage hook 152H of a latch 152 included in footrest lock 15 from the latch retainer 452 in footrest lock receiver 141 formed in footrest 14.

Figure 8A:
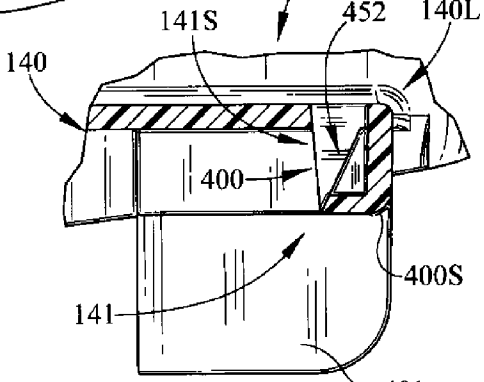
FIG. 8A is an enlarged sectional view taken along line 8A-8A of FIG. 8 to show a convex curved exterior hook-camming surface provided on an L-shaped latch cam included in the footrest lock receiver.

Footrest lock receiver 141 is included in footrest 14 as shown, for example, in FIGS. 7, 8, and 8A. Footrest 14 illustratively includes a footrest shell 140 configured to receive the feet (not shown) of a juvenile seated in central base 12 and shell-pivot axles 140A, 140B arranged to extend along footrest axis 14A and mate with companion axle receivers 140AR, 140BR formed in central base 12 as suggested in FIGS. 4 and 7. Footrest shell 140 can be formed to have any suitable size and shape in accordance with the present disclosure.

Footrest lock receiver 141 is coupled to the underside of footrest shell 140 and provided at a rear lip 140L of footrest shell 140 as shown, for example, in FIGS. 7, 8, and 8A. Footrest lock receiver 141 includes a rearwardly extending first rigidifier plate 401, a laterally spaced-apart second rigidifier plate 402, a rigidified latch cam 400 arranged to lie between and interconnect first and second rigidifier plates 401, 402, and a latch retainer 452 as shown best in FIG. 8. Footrest lock receiver 141 is formed to include a hook-retainer space 141S bounded in part by plates 401, 402 and latch retainer 452 as suggested in FIGS. 8 and 8A. Rigidified latch cam 400 includes a convex curved exterior hook-camming surface 400S as shown best in FIGS. 8A and 12A.

Use of latch cam 400 in footrest lock receiver 141 to cam spring-biased latch 152 in footrest lock 15 and subsequent engagement of latch 152 and latch retainer 452 also included in footrest lock receiver 141 is shown, for example, in FIGS. 9-16A. A close-up view of a hook 152H included in latch 152 as it moves relative to footrest 14 is provided in each of FIGS. 10A, 12A, 14A, and 16A.

Footrest 14 is shown in its collapsed-storage position in FIGS. 9, 9A, 10, and 10A. At this stage, latch 152 of headrest lock 15 is separated from each of latch cam 400 and latch retainer 452 of footrest lock receiver 141 of footrest 14 as shown in FIG. 10. An illustrative curvature of cam-follower surface 152H1 and an illustrative flat surface of cam-retainer surface 152R1 is shown in FIG. 10A.

Pivotable movement of footrest 14 about footrest axis 14 in counterclockwise direction 101 toward an expanded-use position is suggested in FIG. 11. The convex exterior cam-follower surfaces 152H1, 152H2 of hook 152H included in latch 152 are shown in FIG. 11A just before they mate in camming engagement with curved exterior surface 400S included in latch cam 400 of footrest lock receiver 141 of footrest 14. Once matching camming engagement begins, spring 153 will be loaded against flange 207 as footrest 14 continues to move toward the expanded-use position.

The footrest 14 is shown in a position in FIG. 13 that is occupied just before footrest 14 reaches the expanded-use position shown in FIG. 15. A tip 152T of the hook 152H of the latch 152 engages an exterior surface of latch cam 400 at this stage just before snap-engagement of the hook 152H of the spring-biased latch 152 to place the hook-retainer surfaces 152R1, 152R2 of latch 152 in mating engagement with latch retainer 452 to retain footrest 14 in the expanded-use position as shown, for example, in FIGS. 15, 16, and 16A.

Figure 21:
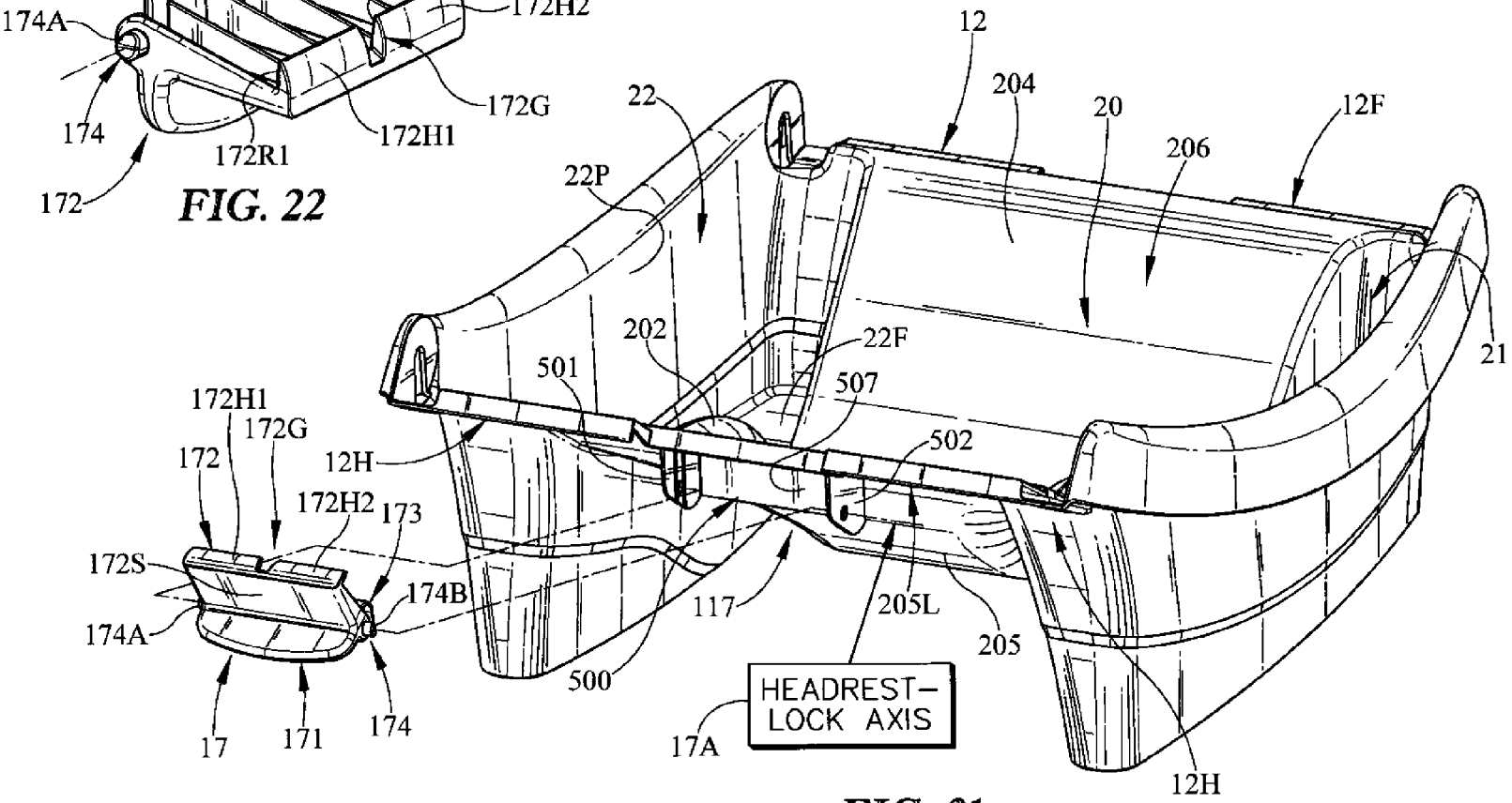
FIG. 21 is an enlarged partial perspective view of a head end of the central base and showing that the central base is formed to include a headrest lock mount located under the seat of the elevated child-receiving cradle included in the central base and configured to support the headrest lock for pivotable movement about a headrest-lock axis.

As suggested in FIGS. 4 and 21, releasable headrest lock 17 is configured to be coupled to a headrest lock mount 117 formed in head end 12H of central base 12. Headrest lock 17 is mounted as suggested in FIG. 21 for pivotable movement about a headrest-lock axis 17A at the option of a caregiver to lock and unlock headrest 16 to control pivotable movement of headrest 16 about headrest axis 16A between an expanded-use position shown in FIG. 1 and a collapsed-storage position shown in FIG. 3.

Figure 22:
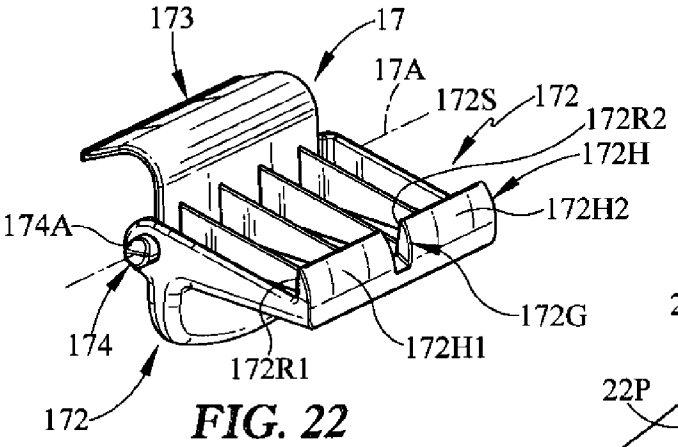
FIG. 22 is an enlarged perspective view of the headrest lock shown in FIGS. 4 and 5 and showing that the headrest lock includes a pivot axle extending along the headrest-lock axis, a latch extending to the right, a latch-biasing spring extending upwardly and to the left, and a downwardly extending latch-release handle and showing that the latch includes a hook carried on the free end of a cantilevered hook support.

Releasable headrest lock 17 includes a latch-release handle 171, a latch 172, a latch-biasing spring 173, and a pivot axle 174 arranged to extend along headrest-lock axis 17A as shown, for example, in FIG. 22. Headrest lock 17 is a monolithic element made of an elastic plastics material in an illustrative embodiment. Latch-biasing spring 173 is sized and shaped to engage a flange 507 coupled to the underside of child-support surface 203 as suggested in FIG. 21 and to deform elastically to provide spring means for yieldably biasing latch 172 to mate with a latch retainer 652 included in headrest 16 so that headrest 16 is retained in the expanded-use position automatically whenever a caregiver moves the headrest 16 about headrest pivot axis 16A in clockwise direction 102 to assume the expanded-use position.

As suggested in FIG. 22, latch 172 of headrest lock 17 includes a hook support 172S and a hook 172H coupled to a free end of hook support 172S. Hook 172H is formed to include: (1) two side-by-side, spaced-apart, convex, exterior, cam-follower surfaces 172S1, 172S2; (2) oppositely facing hook-retainer surfaces 172R1, 172R2; and (3) tips 172T1, 172T2 located between the cam-follower surfaces and the hook-retainer surfaces, as shown, for example, in FIG. 22. In illustrative embodiments, a rib-receiving gap 172G is provided between these cam-follower surfaces 172S1, 172S2 as suggested in FIGS. 21 and 22. Such a rib-receiving gap 172G is sized to receive a rib 162 shown, for example, in FIGS. 3 and 9 coupled to an underside of a headrest shell 160 included in headrest 16 when headrest 16 is moved to assume the expanded-use position shown in FIG. 1.

Headrest lock mount 117 is formed in central base 12 of juvenile tub 10 as shown, for example, in FIG. 21. Headrest lock mount 117 is coupled to the underside of the rearwardly sloping inclined backrest 205 and a laterally extending lip 205L associated with rearwardly sloping inclined backrest 205 and provided at head end 12H of central base 12. Headrest lock mount 117 includes a rearwardly extending first axle-mount flange 501, a laterally spaced-apart rearwardly extending second axle-mount flange 502, and a rigidifying structure 500 arranged to lie between and interconnect first and second axle-mount flanges 501, 502 as shown, for example, in FIG. 21. Each of axle-mount flanges 501, 502 is formed to have the axle-receiving features provided in flanges 301, 302.

Figures 23, 24, 24A:
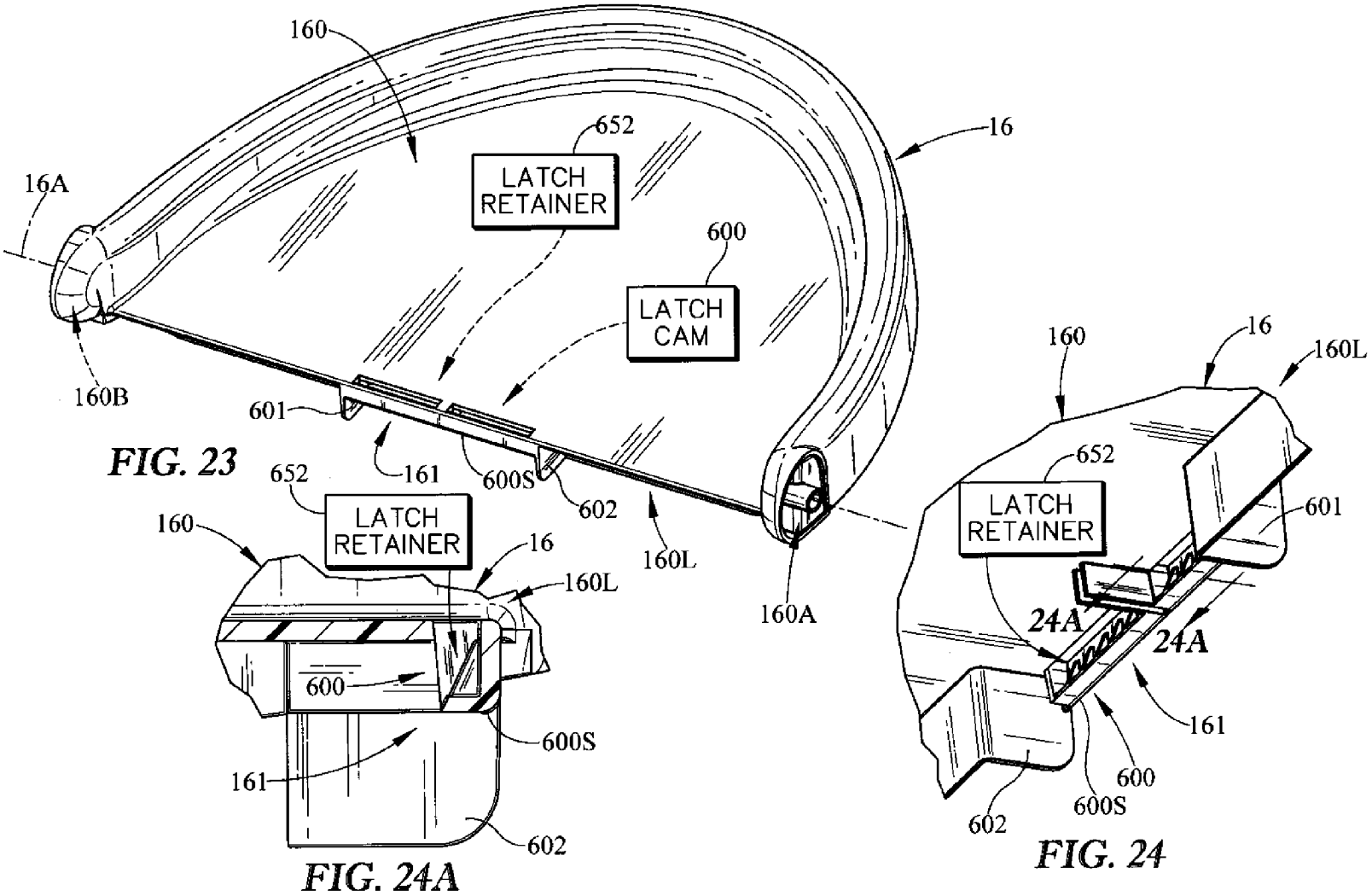
FIG. 23 is an enlarged perspective view of the headrest.
FIG. 24 is an enlarged perspective view of a portion of the headrest showing the headrest lock receiver formed therein.
FIG. 24A is an enlarged sectional view taken along line 24A-24A showing a convex curved exterior hook-camming surface provided on an L-shaped latch cam included in the headrest lock receiver formed in the headrest.

Releasable headrest lock 17 mounted on central base 12 is configured to mate with a headrest lock receiver 161 included in headrest 16 as suggested diagrammatically in FIG. 4 and illustratively in FIGS. 23 and 24 automatically whenever a caregiver pivots headrest 16 about headrest pivot axis 16A in clockwise direction 102 from the collapsed-storage position shown in FIG. 3 to the expanded-use position shown in FIG. 1. Headrest 16 is locked temporarily in the expanded use position whenever headrest lock 17 mates with headrest lock receiver 161 of headrest 17. To unlock headrest 16 so that it is free to be pivoted to the collapsed-storage position overlying central base 12 as shown in FIG. 3, a caregiver need only reach under headrest 16 and grip a latch-release handle 171 included in headrest lock 17 and then apply a torque to rotate headrest lock 17 to disengage hook 172H of latch 172 included in headrest lock 17 from headrest lock receiver 161 formed in headrest 16.

Headrest lock receiver 161 is included in headrest 16 as shown, for example, in FIGS. 23, 24, and 24A. Headrest 16 illustratively includes a headrest shell 160 configured to receive the head (not shown) of a juvenile seated in central base 12 and shell-pivot axles 160A, 160B arranged to extend along headrest axis 16A and mate with companion axle receivers 160AR, 160BR formed in central base 12 as suggested in FIGS. 4 and 23. Headrest shell 160 can be formed to have any suitable size and shape in accordance with the present disclosure.

Headrest lock receiver 161 is coupled to the underside of headrest shell 160 and provided on a front lip 160L of headrest shell 160 as shown, for example, in FIGS. 23, 24, and 24A. Headrest lock receiver 161 includes a forwardly extending first rigidifier plate 601, a laterally spaced-apart second rigidifier plate 602, a rigidified latch cam 600 arranged to lie between and interconnect first and second rigidifier plates 601, 602, and a latch retainer 652 as shown best in FIG. 24. Rigidified latch cam 600 includes a convex curved exterior hook-camming surface 600S. Latch 172 associated with headrest 16 operates in a manner similar to the latch 152 that is associated with footrest 14 to lock headrest 16 in the expanded-use position shown in FIG. 1 in response to pivoting movement of headrest 16 from the collapsed-storage position shown in FIG. 3 about headrest pivot axis 16A in clockwise direction 102.

Ergonomically contoured first and second side bolsters 201, 202 cooperate to position children of varying sizes on concave child-support surfaces 203 while allowing collapsible pivotable movement of each of footrest 14 and headrest 16 between the expanded-use positions shown in FIG. 1 and the collapsed-storage positions shown in FIG. 3. Each of footrest lock 15 and headrest lock 17 is configured to include a one-handed release mechanism to facilitate fold-up of bathtub 10 to a compact form for storage.

The invention claimed is:

1. A juvenile tub comprising a central base having a foot end, an opposite head end, and a child-receiving cradle extending between the foot end and the head end, a foldable footrest mounted on the foot end of the central base for pivotable movement about a footrest axis between a collapsed-storage position overlying a first portion of the child-receiving cradle and an expanded-use position extending away from the child-receiving cradle and the head end of the central base, a foldable headrest mounted on the head end of the central base for pivotable movement about a headrest axis between a collapsed-storage position overlying a second portion of the child-receiving cradle and an expanded-use position extending away from the child-receiving cradle and the foot end of the central base, an expanded-use position retainer including a footrest lock mounted for movement on the foot end of the central base to extend into and mate with a footrest lock receiver formed in the footrest in response to pivotable movement of the foldable footrest about the footrest axis to the expanded-use position to retain the footrest in the expanded-use position relative to the central base and a headrest lock mounted for movement on the head end of the central base to extend into and mate with a headrest lock receiver formed in the headrest in response to pivotable movement of the foldable headrest about the headrest axis to the expanded-use position to retain the headrest in the expanded-use position relative to the central base, and wherein the central base is formed to include a left-side bathwater reservoir and a right-side bathwater reservoir arranged to lie in laterally spaced-apart relation to the left-side bathwater reservoir to locate the child-receiving cradle therebetween, and the child-receiving cradle includes a child-support surface arranged to extend from the foot end to the head end, an upwardly extending first side bolster located between the left-side bathwater reservoir and the child-support surface, and an upwardly extending second side bolster located between the right-side bathwater reservoir and the child-support surface, wherein each of the left-side and right-side bathwater reservoirs is defined by a low-elevation floor and an endless side panel surrounding and extending upwardly from a perimeter edge of the low-elevation floor.

2. A juvenile tub comprising a central base having a foot end, an opposite head end, and a child-receiving cradle extending between the foot end and the head end, a foldable footrest mounted on the foot end of the central base for pivotable movement about a footrest axis between a collapsed-storage position overlying a first portion of the child-receiving cradle and an expanded-use position extending away from the child-receiving cradle and the head end of the central base, a foldable headrest mounted on the head end of the central base for pivotable movement about a headrest axis between a collapsed-storage position overlying a second portion of the child-receiving cradle and an expanded-use position extending away from the child-receiving cradle and the foot end of the central base, an expanded-use position retainer including a footrest lock mounted for movement on the foot end of the central base to extend into and mate with a footrest lock receiver formed in the footrest in response to pivotable movement of the foldable footrest about the footrest axis to the expanded-use position to retain the footrest in the expanded-use position relative to the central base and a headrest lock mounted for movement on the head end of the central base to extend into and mate with a headrest lock receiver formed in the headrest in response to pivotable movement of the foldable headrest about the headrest axis to the expanded-use position to retain the headrest in the expanded-use position relative to the central base, and wherein the central base is formed to include a left-side bathwater reservoir and a right-side bathwater reservoir arranged to lie in laterally spaced-apart relation to the left-side bathwater reservoir to locate the child-receiving cradle therebetween, and the child-receiving cradle includes a child-support surface arranged to extend from the foot end to the head end, an upwardly extending first side bolster located between the left-side bathwater reservoir and the child-support surface, and an upwardly extending second side bolster located between the right-side bathwater reservoir and the child-support surface, wherein the pivotable footrest lock is mounted for pivotable movement about a footrest-lock axis on a footrest lock mount included in the foot end of the central base and located adjacent to the child-support surface and between the left-side and right-side bathwater reservoirs.

3. The juvenile tub of claim 1, wherein the pivotable headrest lock is mounted for pivotable movement about a headrest-lock axis on a headrest mount included in the head end of the central base and located adjacent to the child-support surface and between the left-side and right-side bathwater reservoirs.

4. The juvenile tub of claim 1, wherein, the child-receiving cradle is configured to cooperate with the first and second side bolsters to provide an elevated bathwater channel in which a child can be retained and bathed during bath time and that is located in an elevated position above the low-elevation floors of the bathwater reservoirs, the first and second side bolsters are laterally spaced apart from one another and cooperate to form side walls of the elevated bathwater channel, and the child-support surface provides a floor of the elevated bathwater channel.

5. The juvenile tub of claim 4, wherein the child-support surface includes a forwardly sloping inclined seat extending from the foot end of the central base to a midpoint of the first and second side bolsters and a rearwardly sloping inclined backrest extending from the forwardly sloping inclined seat to the head end of the central base and cooperating with the forwardly sloping inclined seat to define the floor of the elevated bathwater channel and provide the floor with an upwardly opening concave outer surface.

6. The juvenile tub of claim 5, further comprising a pliable bath mat including, in series, a foot portion mating with the foldable footrest, a seat portion mating with the forwardly sloping inclined seat of the central base, a back portion mating with the rearwardly sloping inclined backrest, and a head portion mating with the foldable headrest.

7. The juvenile tub of claim 1, wherein the child-support surface has a generally hourglass-shaped profile when viewed from above, the first side bolster includes a convex exterior surface arranged to face toward the child-support surface, and the second side bolster includes a convex exterior surface arranged to face toward the child-support surface and the convex exterior surface of the first side bolster and cooperate therewith to form an elevated bathwater channel located between the left-side and right-side bathwater reservoirs.

8. The juvenile tub of claim 7, wherein the child-support surface includes a forwardly sloping inclined seat extending from the footrest end of the central base to a midpoint of the first and second side bolsters and a rearwardly sloping inclined backrest extending from the forwardly sloping inclined seat to the headrest end of the central base and cooperating with the forwardly sloping inclined seat to define the floor of the elevated bathwater channel.

9. The juvenile tab of claim 7, wherein the child-support surface includes a left concave curved perimeter edge along a left side thereof and a right concave curved perimeter edge along a right side thereof, the convex exterior surface of the first side bolster includes a convex curved perimeter edge arranged to mate with and extend along the left concave curved perimeter edge of the child-support surface, and the convex exterior surface of the second side bolster includes a convex curved perimeter edge arranged to mate with and extend along the right concave curved perimeter edge of the child-support surface.

10. The juvenile tub of claim 1, wherein the first and second side bolsters rise upwardly above the child-support surface and cooperate to provide means for limiting lateral side-to-side movement of an infant child placed on the child-support surface during bathing of the infant child.

11. The juvenile tub of claim 1, wherein the footrest lock comprises a latch, a pivot axle arranged to extend along the footrest-lock axis to support the latch for pivotable movement about the footrest-lock axis relative to the foot end of the central base, and spring means for yieldably biasing the latch to pivot on the pivot axle about the footrest-lock axis in a clockwise direction relative to the central base to mate with a latch retainer formed in the footrest lock receiver of the foldable footrest so that the footrest is retained in the expanded-use position automatically whenever a caregiver pivots the foldable footrest about the footrest axis to assume the expanded-use position.

12. The juvenile tub of claim 11, wherein the footrest lock further includes a latch-release handle coupled to the latch and the footrest lock is a monolithic element made of an elastic plastics material to provide elasticity to the spring means.

13. The juvenile tub of claim 11, wherein the spring means includes a free end engaging a base flange coupled to an underside of the child-receiving cradle of the central base.

14. The juvenile tub of claim 13, wherein the footrest lock further includes a latch-release handle coupled to the latch and the footrest lock is a monolithic element made of an elastic plastics material to provide elasticity to the spring means, the spring means is defined by a sheet made of the elastic plastics material and formed to have a V-shaped cross-section and to include a distal flat panel including the free end and engaging the base flange, a proximal flat panel anchored to a body comprising the latch and the latch-release handle, and a curved bight panel arranged to interconnect the distal and proximal flat panels.

15. The juvenile tub of claim 11, wherein the footrest lock further includes a latch-release handle coupled to the latch to pivot therewith and configured to provide means for pivoting the latch about the footrest-lock axis in a counterclockwise direction relative to the central base to disengage the latch retainer formed in the footrest lock receiver of the foldable footrest to free the foldable footrest to be pivoted by a caregiver about the footrest axis from the expanded-use position to the collapsed-storage position to load the spring means.

16. The juvenile tub of claim 11, wherein the latch includes a cantilevered hook support having a proximal end coupled to the pivot axle and a hook coupled to a free end of the cantilevered hook support, the hook includes a first convex, exterior, cam-follower surface and an oppositely facing hook-retainer surface arranged to face toward the spring means and the pivot axle, the footrest lock receiver includes a latch retainer arranged to face away from the foot end of the central base when the foldable footrest lies in the expanded-use position and a latch cam arranged to face toward the foot end of the central base and formed to include a convex curved exterior hook-camming surface arranged to engage the first convex, exterior, cam-follower surface of the hook during pivoting movement of the foldable footrest about the footrest axis from the collapsed-storage position to the expanded-use position until a tip of the hook interposed between the first convex, exterior, cam-follower surface of the hook and the hook-retainer surface of the hook is moved past the convex curved exterior hook-camming surface to extend into a hook-retainer space provided in the footrest and to cause the hook-retainer surface of the hook to mate with the latch retainer of the footrest lock receiver.

17. The juvenile tub of claim 16, wherein the spring means acts against the central base to apply a torque to the latch yieldably to cause the hook-retainer surface of the hook to remain in mating engagement with the latch retainer of the footrest lock receiver once the footrest is pivoted about the footrest axis to assume the expanded-use position.

18. The juvenile tub of claim 17, wherein the footrest lock further includes a latch-release handle coupled to the proximal end of the latch to pivot with the latch and configured to provide means for pivoting the latch about the footrest-lock axis in a counterclockwise direction relative to the central base to cause the hook-retainer surface of the hook of the latch to disengage the latch retainer formed in the footrest lock receiver to free the foldable footrest to be pivoted by a caregiver about the footrest axis from the expanded-use position to the collapsed-storage position to load the spring means.

19. The juvenile tub of claim 16, wherein the foldable footrest includes a footrest shell configured to receive feet of an infant child seated in the child-receiving cradle of the central base and shell-pivot axles arranged to extend along the footrest axis and mate with companion axle receivers formed in the foot end of the central base, the foot receiver lock includes a first rigidifier plate coupled to an underside of the footrest shell, a second rigidifier plate coupled to the underside of the footrest shell and arranged to lie in laterally spaced-apart relation to the first rigidifier plate, and the latch retainer is arranged to lie between and interconnect the first and second rigidifier plates and cooperate with the first and second rigidifier plates to form a hook-retainer space under the underside of the footrest shell to receive the hook of the latch when the footrest is moved to assume the expanded-use position.

20. The juvenile tub of claim 1, wherein the headrest lock comprises a latch, a pivot axle arranged to extend along the headrest-lock axis to support the latch for pivotable movement about the headrest-lock axis relative to the head end of the central base, and spring means for yieldably biasing the latch to pivot on the pivot axle about the headrest-lock axis in a clockwise direction relative to the central base to mate with a latch retainer formed in the headrest lock receiver of the foldable headrest so that the headrest is retained in the expanded-use position automatically whenever a caregiver pivots the foldable headrest about the headrest axis to assume the expanded-use position.

21. The juvenile tub of claim 20, wherein the headrest lock further includes a latch-release handle coupled to the latch and the headrest lock is a monolithic element made of an elastic plastics material to provide elasticity to the spring means.

22. The juvenile tub of claim 20, wherein the spring means includes a free end engaging a base flange coupled to an underside of the child-receiving cradle of the central base.

23. The juvenile tub of claim 22, wherein the headrest lock further includes a latch-release handle coupled to the latch and the headrest lock is a monolithic element made of an elastic plastics material to provide elasticity to the spring means, the spring means is defined by a sheet made of the elastic plastics material and formed to have a V-shaped cross-section and to include a distal flat panel including the free end and engaging the base flange, a proximal flat panel anchored to a body comprising the latch and the latch-release handle, and a curved bight panel arranged to interconnect the distal and proximal flat panels.

24. The juvenile tub of claim 20, wherein the headrest lock further includes a latch-release handle coupled to the latch to pivot therewith and configured to provide means for pivoting the latch about the headrest-lock axis in a counterclockwise direction relative to the central base to disengage the latch retainer formed in the headrest lock receiver of the foldable headrest to free the foldable headrest to be pivoted by a caregiver about the headrest axis from the expanded-use position to the collapsed-storage position to load the spring means.

25. The juvenile tub of claim 20, wherein the latch includes a cantilevered hook support having a proximal end coupled to the pivot axle and a hook coupled to a free end of the cantilevered hook support, the hook includes a first convex, exterior, cam-follower surface and an oppositely facing hook-retainer surface arranged to face toward the spring means and the pivot axle, the headrest lock receiver includes a latch retainer arranged to face away from the head end of the central base when the foldable headrest lies in the expanded-use position and a latch cam arranged to face toward the head end of the central base and formed to include a convex curved exterior hook-camming surface arranged to engage the first convex, exterior, cam-follower surface of the hook during pivoting movement of the foldable headrest about the headrest axis from the collapsed-storage position to the expanded-use position until a tip of the hook interposed between the first convex, exterior, cam-follower surface of the hook and the hook-retainer surface of the hook is moved past the convex curved exterior hook-camming surface to extend into a hook-retainer space provided in the headrest and to cause the hook-retainer surface of the hook to mate with the latch retainer of the headrest lock receiver.

26. The juvenile tub of claim 25, wherein the spring means acts against the central base to apply a torque to the latch yieldably to cause the hook-retainer surface of the hook to remain in mating engagement with the latch retainer of the headrest lock receiver once the headrest is pivoted about the headrest axis to assume the expanded-use position.

27. The juvenile tub of claim 26, wherein the headrest lock further includes a latch-release handle coupled to the proximal end of the latch to pivot with the latch and configured to provide means for pivoting the latch about the headrest-lock axis in a counterclockwise direction relative to the central base to cause the hook-retainer surface of the hook of the latch to disengage the latch retainer formed in the headrest lock receiver to free the foldable headrest to be pivoted by a caregiver about the headrest axis from the expanded-use position to the collapsed-storage position to load the spring means.

28. The juvenile tub of claim 25, wherein the foldable headrest includes a headrest shell configured to receive the head of an infant child seated in the child-receiving cradle of the central base and shell-pivot axles arranged to extend along the headrest axis and mate with companion axle receivers formed in the head end of the central base, the head receiver lock includes a first rigidifier plate coupled to an underside of the headrest shell, a second rigidifier plate coupled to the underside of the headrest shell and arranged to lie in laterally spaced-apart relation to the first rigidifier plate, and the latch retainer is arranged to lie between and interconnect the first and second rigidifier plates and cooperate with the first and second rigidifier plates to form a hook-retainer space under the underside of the headrest shell to receive the hook of the latch when the headrest is moved to assume the expanded-use position.

* * * * *